US005970906A

United States Patent [19]

Hrescak et al.

[11] Patent Number: 5,970,906

[45] Date of Patent: Oct. 26, 1999

[54] MOTION COMPENSATION WINCH

[75] Inventors: Stan Hrescak, Burnaby; James R. Webber, North Delta, both of Canada

[73] Assignee: Pullmaster Winch Corporation, Surrey, Canada

[21] Appl. No.: 08/949,304

[22] Filed: Oct. 13, 1997

[51] Int. Cl.[6] ..... B63B 23/00

[52] U.S. Cl. ..... 114/378; 254/172

[58] Field of Search ..... 114/366, 367, 114/378, 379, 160; 254/172

[56] References Cited

U.S. PATENT DOCUMENTS

| | | | |
|---|---|---|---|
| 1,804,945 | 5/1931 | Miller . | |
| 2,183,542 | 12/1939 | Chantry | 254/173 |
| 3,259,371 | 7/1966 | Goepfert et al. | 254/173 |
| 3,261,591 | 7/1966 | Campbell et al. | 254/172 |
| 3,279,761 | 10/1966 | Schreiber | 254/172 |
| 3,481,584 | 12/1969 | Conry et al. | 254/172 |
| 3,675,900 | 7/1972 | Barron et al. | 254/172 |
| 3,817,033 | 6/1974 | Appel et al. | 60/444 |
| 3,838,846 | 10/1974 | Ostrom | 254/172 |
| 4,034,963 | 7/1977 | Warman et al. | 254/173 B |
| 4,118,012 | 10/1978 | Kerr et al. | 254/173 R |
| 4,324,385 | 4/1982 | Cojean et al. | 254/270 |
| 4,349,179 | 9/1982 | Barber | 254/270 |
| 4,354,608 | 10/1982 | Wudtke | 212/191 |
| 4,395,178 | 7/1983 | MacDonell et al. | 414/138 |
| 4,448,396 | 5/1984 | Delago | 254/340 |
| 4,928,925 | 5/1990 | Christison | 254/272 |
| 5,007,599 | 4/1991 | Forsyth | 242/86.51 |
| 5,114,026 | 5/1992 | Hendrik | 212/191 |

OTHER PUBLICATIONS

Constant–Tension Winch Safely Launches Rescue boats Richard Schneider & pp. 10, 11 The Work Boat Dec. 1987 & New Products—Winch System.

A Constant–Tension Winch System for Handling Rescue Boats S. Grant Christison pp. 220–228 Marine Technology vol. 25, No. 3, Jul. 1988.

*Primary Examiner*—Jesus D. Sotelo

*Attorney, Agent, or Firm*—Christie, Parker & Hale, LLP

[57] ABSTRACT

A motion compensation winch has a number of operating modes to launch and recover a boat and take into account wave movement. The winch has a cable drum for winding a cable thereon, a secondary gear reduction to rotate the drum, a primary gear reduction between a hydraulic motor shaft and the secondary gear reduction, a rotational sensor to sense direction of cable drum rotation, a load sensor to determine when a tension on the cable is above or below a predetermined value and a secondary clutch to disengage the cable drum and permit the cable drum to rotate freely. The winch has a manual mode for manual operation, and four operational modes, an automatic launch mode, a motion compensation mode to keep the cable taut while a boat rises and falls on waves, a free wheel mode and a recovery mode for recovering a boat that is rising and falling on waves.

23 Claims, 11 Drawing Sheets

MOTION COMPENSATION WINCH

FIELD OF THE INVENTION

The present invention relates to a winch to be used for launching a boat from a platform such as a ship to the surface of the sea wherein the distance between the launch platform and the water level changes due to waves and/or movement of the ship.

BACKGROUND ART

In the past most hoisting devices used for lowering lifeboats and the like relied on a winch operator to lower a boat so that the boat reached the surface when the water level is rising rather than falling away. Otherwise the wave falls away under the boat so it is suspended by the cable again. It is also necessary to prevent slack occurring in the hoisting cable. If slack does occur, then when the wave falls away, the slack is taken up and a violent jerk occurs as the weight of the lifeboat is taken by the cable. This jerk action may cause undue stresses in the hoisting cable or in the hoisting connections to the lifeboat. Furthermore, such an action causes discomfort to passengers in a lifeboat.

Various types of winches have been devised to prevent the occurrence of slack in a cable and to prevent the jerk that occurs when the slack is taken up. One such hoisting device is disclosed in U.S. Pat. No. 4,928,925 which discloses a constant tension hoisting member with a separate cable tension sensing system. The hoisting device provides an automatic launching operation but not an automatic recovery arrangement. The winch disclosed in this patent utilizes a main motor and an auxiliary motor.

An aim of the present invention is to provide a winch for launching and recovering an object such as a boat from an active wave environment generally moving relative to a stationary or moving platform where the winch has a number of operational modes which operate separately from a manual operational mode. The operational modes include a launch mode, a motion compensation mode, a free wheel mode and a recovery mode.

It is a further aim of the present invention to provide a motion compensation winch which has a single hydraulic motor and utilizes primary and secondary gear reductions with primary and secondary clutches and incorporates a rotational sensor to sense when the load on the cable is either being raised or lowered by the wave and a load sensor to determine when the load on the cable is above or below a predetermined value. Both the load sensor and the rotational sensor are built into the winch, thus the winch is a completely independent unit suitable for retrofitting to any lifeboat davit or crane. There is no external cable tensioning device needed.

A still further aim of the present invention is to provide a motion compensation mode for a winch so that when a load has been launched and is supported by the water, the winch control lever may be placed in the hoisting position and the cable drum will take up the cable when the load rises and release the cable when the load lowers, always maintaining a tension on the cable. This motion compensation mode is used when a lifeboat or a buoy has been launched and prevents the object from drifting away from the launch platform.

There is also a recovery mode to recover a lifeboat or a buoy from an active wave environment, the load is recovered from the crest of a wave automatically without the operator having to pick the right moment. The recovery mode is selected when the winch is in the compensation mode, regardless of whether the load is rising or falling. The load is automatically recovered from the crest of a wave after rising up on the wave, once recovered, the winch is controlled in manual mode by operating the winch control lever.

SUMMARY OF THE INVENTION

These and other objects are achieved by providing a winch drum that is driven by a primary gear reduction and a secondary gear reduction from a single fixed displacement hydraulic motor. Primary and secondary clutches are provided, the primary clutch engages and disengages the motor drive shaft from an internal gear of the primary gear reduction on a connecting tube. When the primary clutch is engaged, the motor drive shaft and the connecting tube rotate as one and thus the primary reduction is eliminated. When the primary clutch is disengaged, the motor drive shaft drives both the primary gear reduction and the secondary gear reduction, thus the cable drum rotates at a slower speed with full torque to the cable drum.

When the winch is in a motion compensation mode and in a recovery mode, a rotational sensor senses when the winch drum is paying out or paying in and selects a preset high pressure hydraulic oil supply to the primary clutch when the winch drum is paying in, and a preset low pressure hydraulic oil supply to the primary clutch when the winch drum is paying out. Thus, the hydraulic motor, through the primary clutch drives the winch drum with the primary reduction eliminated in the pay in direction, and the load on the cable pulls the winch drum in pay out direction against the oil cooled shipping primary clutch.

The secondary clutch disengages and engages a secondary clutch hub from rotating. The secondary clutch hub is connected by means of a sprag clutch to a connecting tube about the motor drive shaft. When the secondary clutch is engaged to the connecting tube, the primary internal gear is prevented from rotating, thus in a manual mode full gear reduction is provided. The motor drive shaft drives the winch drum at either the high speed rotation or the low speed rotation in the hoisting direction, depending upon whether the primary clutch is engaged or not. When the secondary clutch is disengaged, the winch drum is released to free wheel. In motion compensation mode, the hydraulic motor is activated to rotate the drum in pay in direction while the load pulls the cable in pay out direction.

A load sensor determines when the load on the cable is above or below a predetermined value. When the winch is in the launch mode, it remains in manual mode until the load comes off the cable as the boat is launched. At that time the secondary clutch releases so the drum is able to free wheel. The primary reduction is eliminated as the released secondary clutch does not stop the primary internal gear from rotating. In the motion compensation mode, the motor shaft rotates continuously in the hoisting or pay in direction, as the boat rises on a wave high pressure hydraulic oil is applied to the primary clutch and some slippage occurs in the clutch so that the cable always remains taut. When the boat lowers on a wave, low pressure hydraulic oil is applied to the primary clutch and more slippage occurs in the primary clutch, but the cable still remains taut. Tension remains in the cable at all times. In the recovery mode, the motor shaft rotates continuously in the hoisting or pay in direction, the rotational sensor senses when the boat is rising on a wave, and the instant that the load sensor senses that the cable is taut, the secondary clutch engages preventing the cable drum rotating in the pay out direction, and at the same time permitting the motor drive shaft and the connecting tube to rotate in unison through the sprag clutch of the secondary clutch so the drum rotates in the pay in direction to keep the cable taut as the wave rises until the boat is no longer supported by the wave. The cable drum cannot pay out as the secondary clutch prevents the drum rotating in the pay out direction. The boat is now lifted out of the water with full torque applied to the drum.

The present invention provides a motion compensation winch having an automatic launch mode, a motion compensation mode, a free wheel mode and an automatic recovery mode, as well as a manual operating mode, the winch comprising a cable drum for winding a cable thereon; a secondary gear reduction to rotate the drum; a primary gear reduction between a motor drive shaft and the secondary gear reduction, a hydraulic motor on the motor drive shaft; a primary clutch to engage and disengage the primary gear reduction and drive the cable drum through the secondary gear reduction eliminating the primary gear reduction, thus increasing rotational speed of the cable drum; a rotational sensor to sense direction of cable drum rotation; a load sensor to determine when a tension on the cable is above or below a predetermined value; a secondary clutch to disengage the cable drum and permit the cable drum to rotate freely, and a control system to provide the automatic launch mode wherein the load sensor senses when the tension on the cable is below the predetermined value and disengages the secondary clutch to place the winch in the free wheel mode; the motion compensation mode wherein the rotational sensor senses when the cable drum is paying in, selects a preset high pressure hydraulic oil supply for the primary clutch to increase friction and still permit some clutch slippage to retain tension in the cable, and senses when the cable drum is paying out, selects a preset low pressure hydraulic oil supply for the primary clutch to reduce friction and permit clutch slippage to retain tension in the cable; and the automatic recovery mode wherein the directional sensor senses the cable drum is paying in, and when the load sensor determines the cable is taut and the tension on the cable has increased to the predetermined value, the secondary clutch engages allowing full torque to be applied to the cable drum through the primary gear reduction and the secondary gear reduction to raise the load.

In another embodiment there is provided a method of controlling a motion compensation winch having a cable drum for winding a cable with a load thereon, and a hydraulic motor to drive the cable drum from a motor drive shaft, the method comprising the steps of selecting an operational mode for the winch from an automatic launch mode, a motion compensation mode, a free wheel mode, and an automatic recovery mode; sensing a load on the cable above or below a predetermined value, sensing whether the cable drum is paying in or paying out and manually operating a winch control to provide hydraulic oil to the hydraulic motor to rotate the cable drum for raising or lowering the load.

BRIEF DESCRIPTION OF THE DRAWINGS

In drawings which illustrate embodiments of the present invention.

DESCRIPTION OF THE PREFERRED EMBODIMENT

Figure 1:
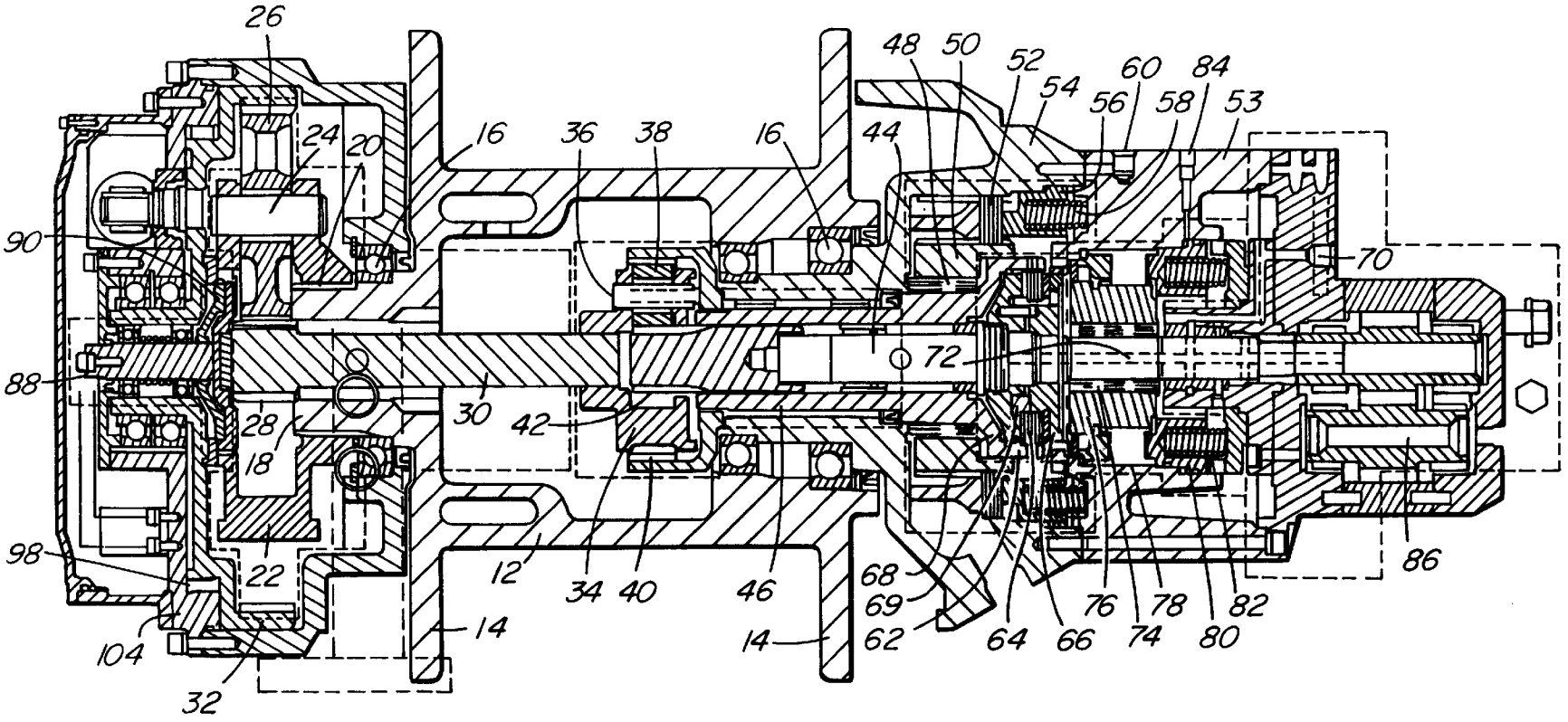
FIG. 1 is an elevational sectional view showing a motion compensation winch according to one embodiment of the present invention.

Referring now to FIG. 1, the motion compensation winch 10 has a cable drum 12 with flanges 14 on either side. The drum 12 rotates in bearings 16. A drum hub 18 extends from the left of the drum 12 and has an external spline 20 engaging a secondary planet hub 22. A secondary planet pin 24 in the secondary planet hub 22 has a secondary planet gear 26 rotating thereon which in turn is rotated by a secondary sun gear 28 on a sun gear shaft 30. The secondary planet gear 26 rotates in an internal gear 32 which has limited rotation and forms part of the rocker gear movement as will be described hereafter. These gears make up what is referred to as the secondary reduction. The sun gear shaft 30 is connected to a primary planet hub 34 having a primary planet pin 36 with a primary planet gear 38 rotating thereon. The primary planet gear 38 rotates in a primary internal gear 40 and is driven by a primary sun gear 42 which is connected directly to the motor shaft 44. This gear reduction system is referred to as the primary reduction.

The primary internal gear 40 is connected to a connecting tube 46 which rotates individually of the motor shaft 44 and has a sprag clutch 48 connecting to a secondary clutch hub 50. A secondary clutch 52 between the secondary clutch hub 50 and the winch housing 54 is controlled by a clutch piston 56 and springs 58. Operation of the secondary clutch is by hydraulic oil pressure through the aperture 60 in the housing 54.

The connecting tube 46 has a connecting hub 62 at one end which has a primary clutch 64 to connect with a primary clutch hub 66 keyed to the motor shaft 44. The primary clutch 64 is operated by a primary clutch piston 68 and springs 69 with hydraulic oil supplied through a pipe connector 70 passing through an aperture 72 within the motor shaft 44.

Adjacent the primary clutch 64 and connected to the motor shaft 44 by a sprag clutch 74 is a brake hub 76 with brake plates 78 between the brake hub 76 and a clutch housing 53. A brake piston 80 and brake springs 82 are operated by hydraulic fluid from a brake line connector 84 in the clutch housing 53.

The drive shaft is driven by a fixed displacement hydraulic motor 86. Hydraulic oil powers the motor 86 and at the same time releases the brake plates 78 when the motor rotates in the lowering direction. When the hydraulic oil is introduced to the hydraulic motor 86 in the hoisting direction, the sprag clutch 74 permits the drive shaft 44 to be rotated freely without releasing the brake plates 78.

Figure 2:
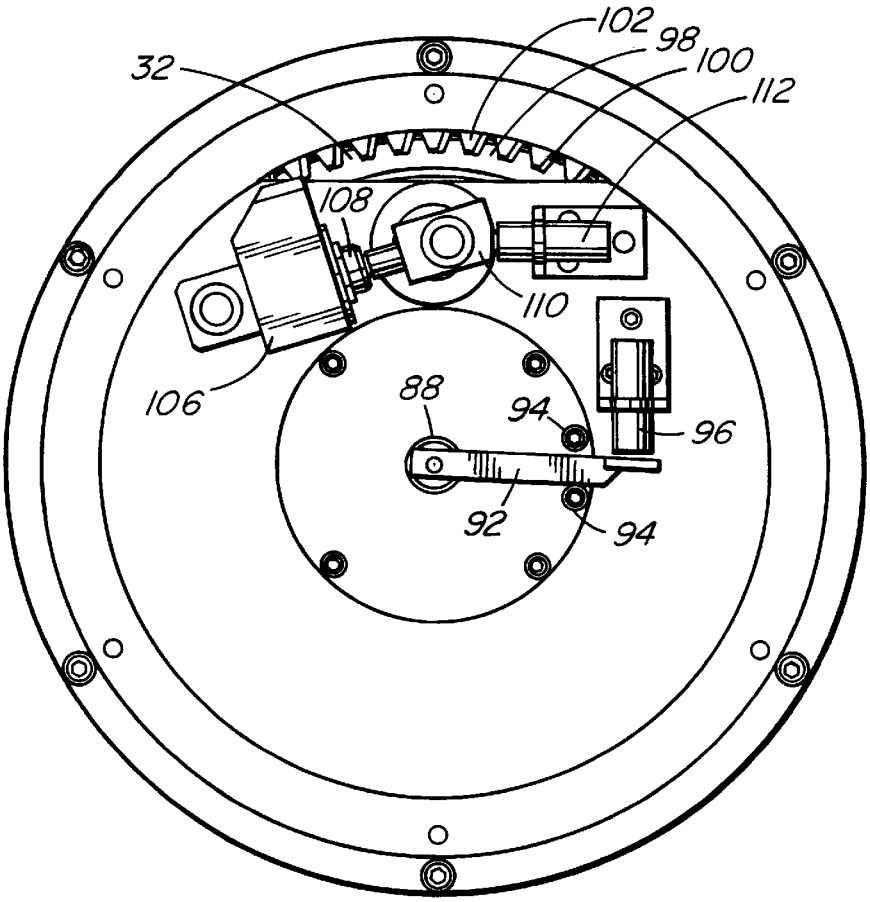
FIG. 2 is an end view showing the motion compensation winch of FIG. 1 with an end cap removed to see the rotational sensor and load sensor.

As shown in FIG. 2, on the end of the winch away from the motor 86 is a direction indicating clutch 88 comprising a pressure plate 90 pressing against a surface of the secondary planet hub 22 as shown in FIG. 1. The clutch 88 is connected to a clutch arm 92 which moves between two pins 94 contacting a directional sensor proximity switch 96 when the cable drum 12 is paying in or paying out.

The secondary reduction internal gear 32 has on its exterior surface a series of gear teeth 98 with an extra large gap 100 between teeth 98. Internal gear teeth 102 of a casing end plate 104 engage with the gear teeth 98. This forms a rocker gear and permits secondary reduction internal gear 32 to rock backwards and forwards within the gap 100. The gap 100 changes from being on the righthand side of the end plate teeth 102 to the lefthand side of the end plate teeth 102 as shown in FIG. 2. A tension cylinder 106 has a rocker piston 108 that moves rocker clevis 110 to contact a load sensor proximity switch 112. This system provides a load sensing on the cable leading from the cable drum 12 and provides an indication when the load on the cable is greater than the load applied by the tension cylinder 106.

Figure 3:
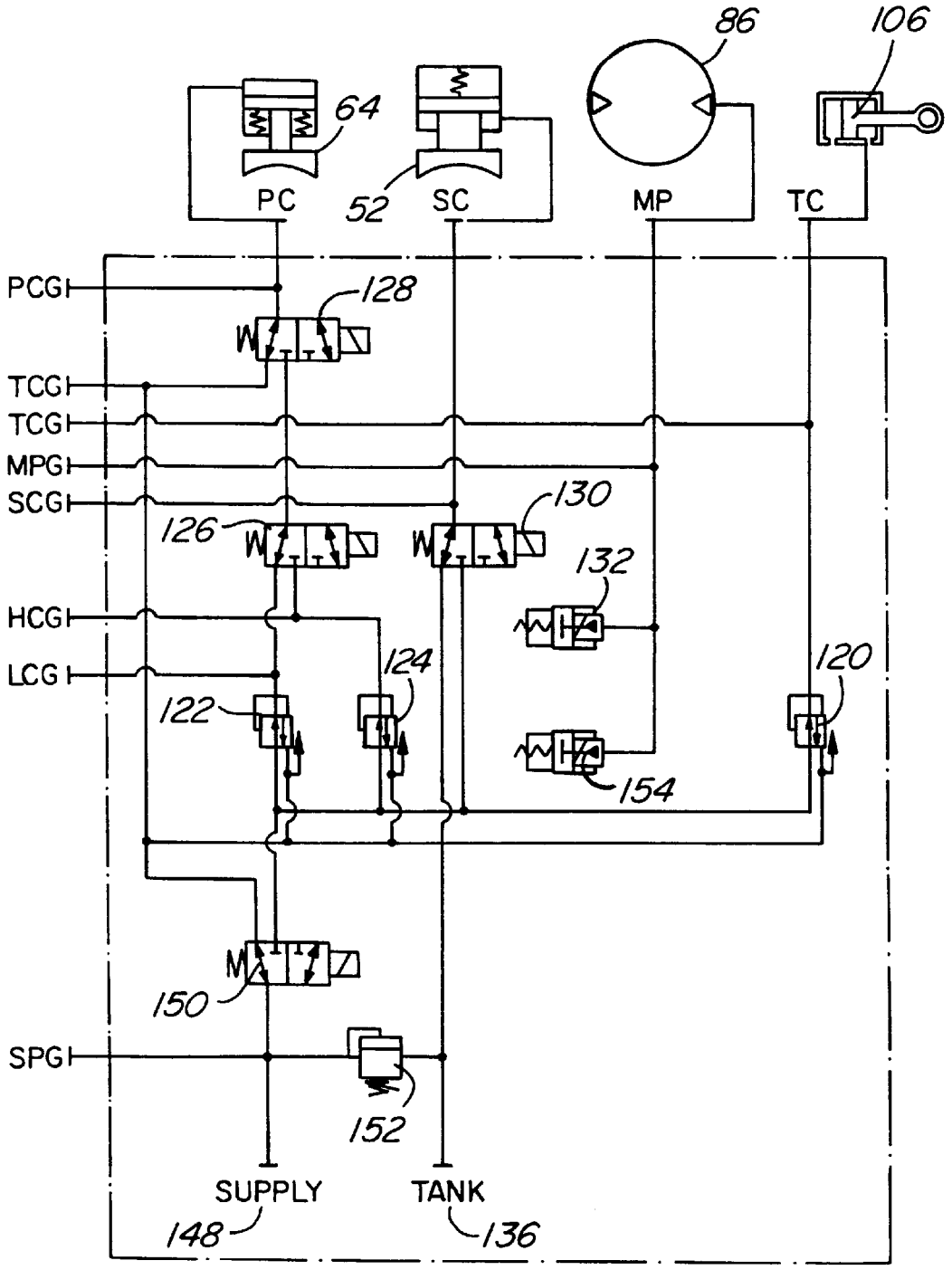
FIG. 3 is a hydraulic schematic diagram for the motion compensation winch of FIG. 1.

The hydraulic circuit for the winch 10 is shown in FIG. 3. Details of operation will be explained hereafter and the control console for the winch is shown in FIG. 4 with a hoist control lever 114 for hoist and pay out positions and control buttons and light indicators shown as will be explained hereafter.

Figure 5:
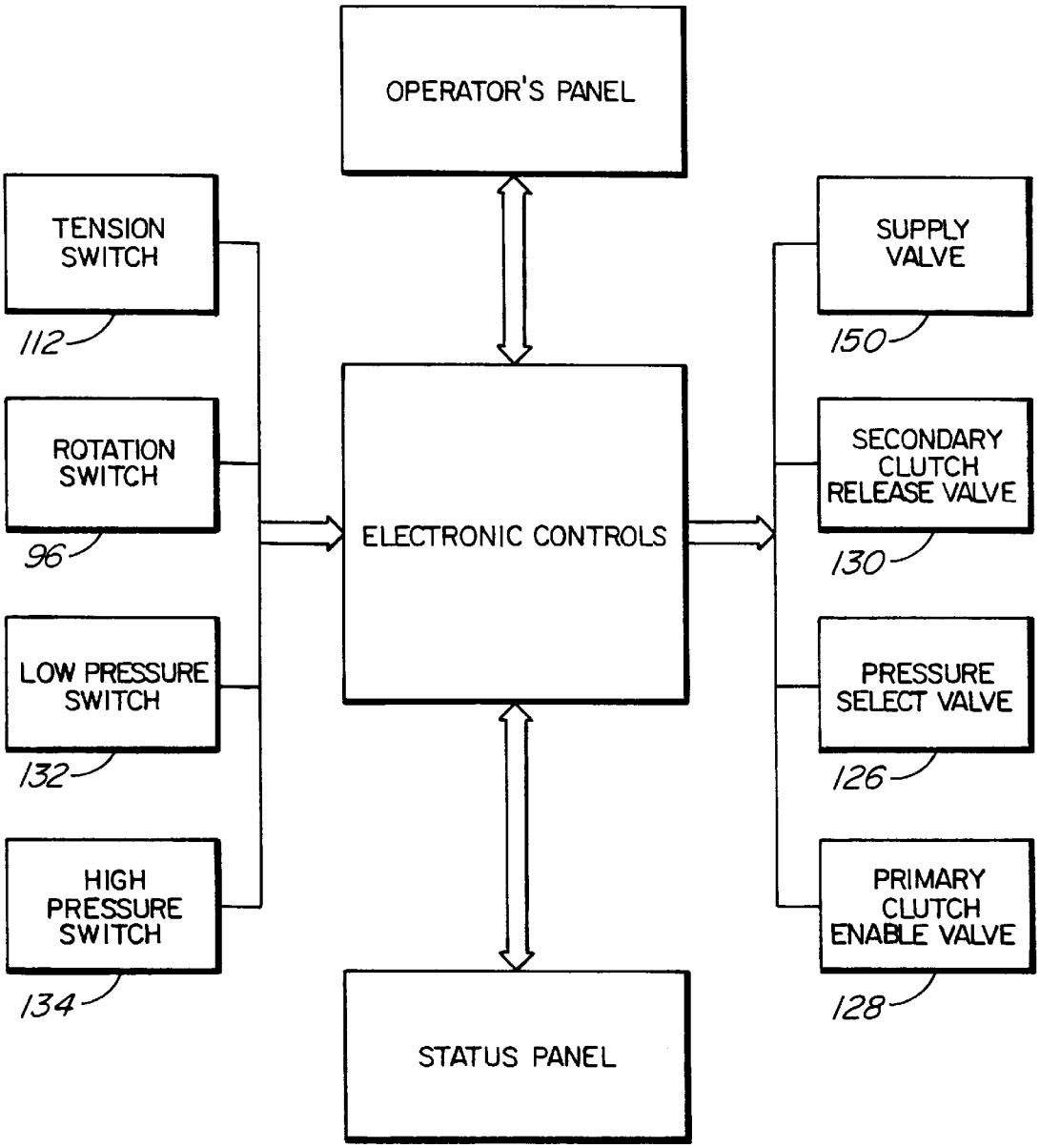
FIG. 5 is a control block diagram for the motion compensation winch of the present invention.
Figure 6:
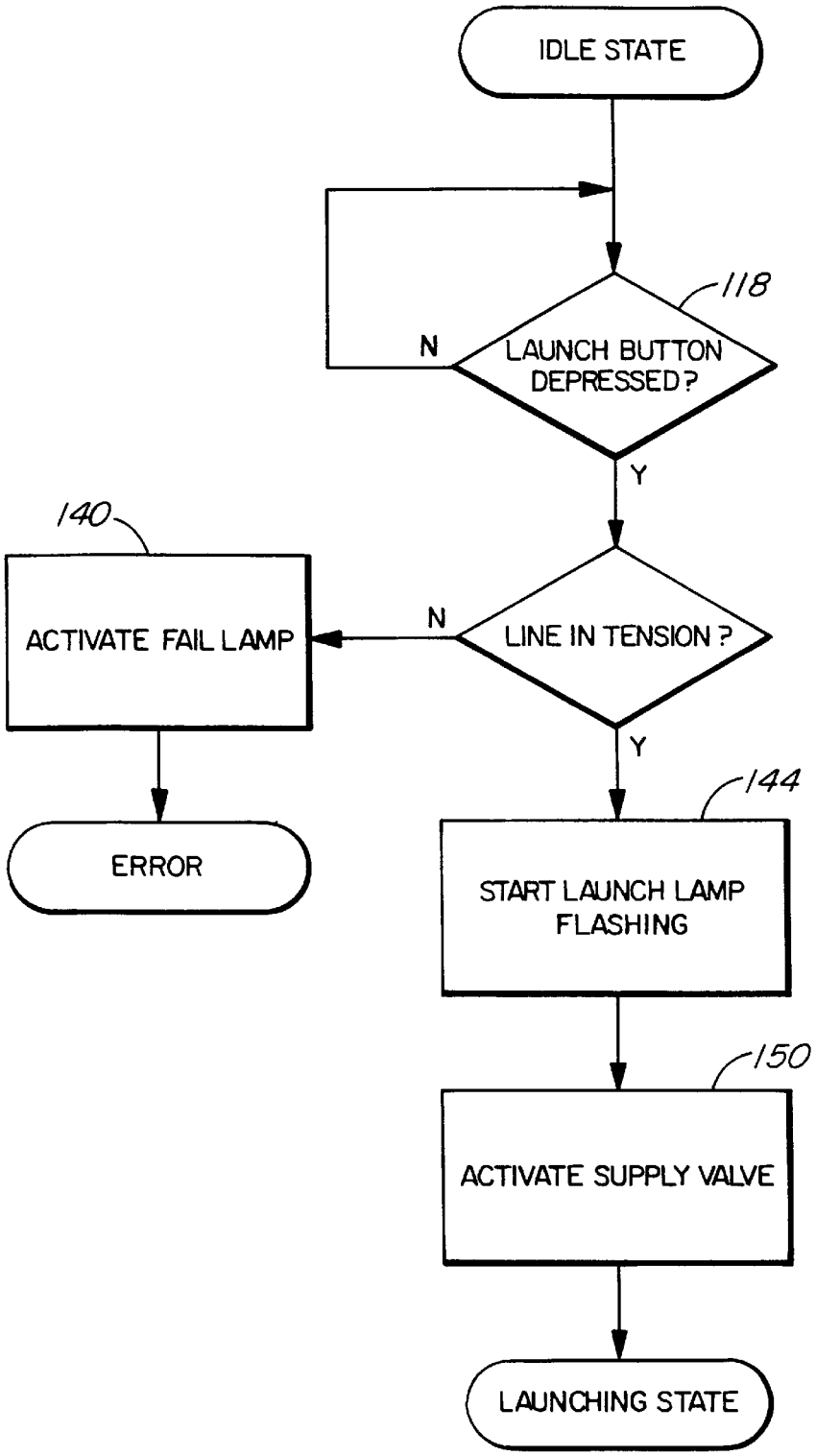
FIGS. 6 to 12 are flow charts for different operational modes of the motion compensation winch of the present invention.
Figure 7:
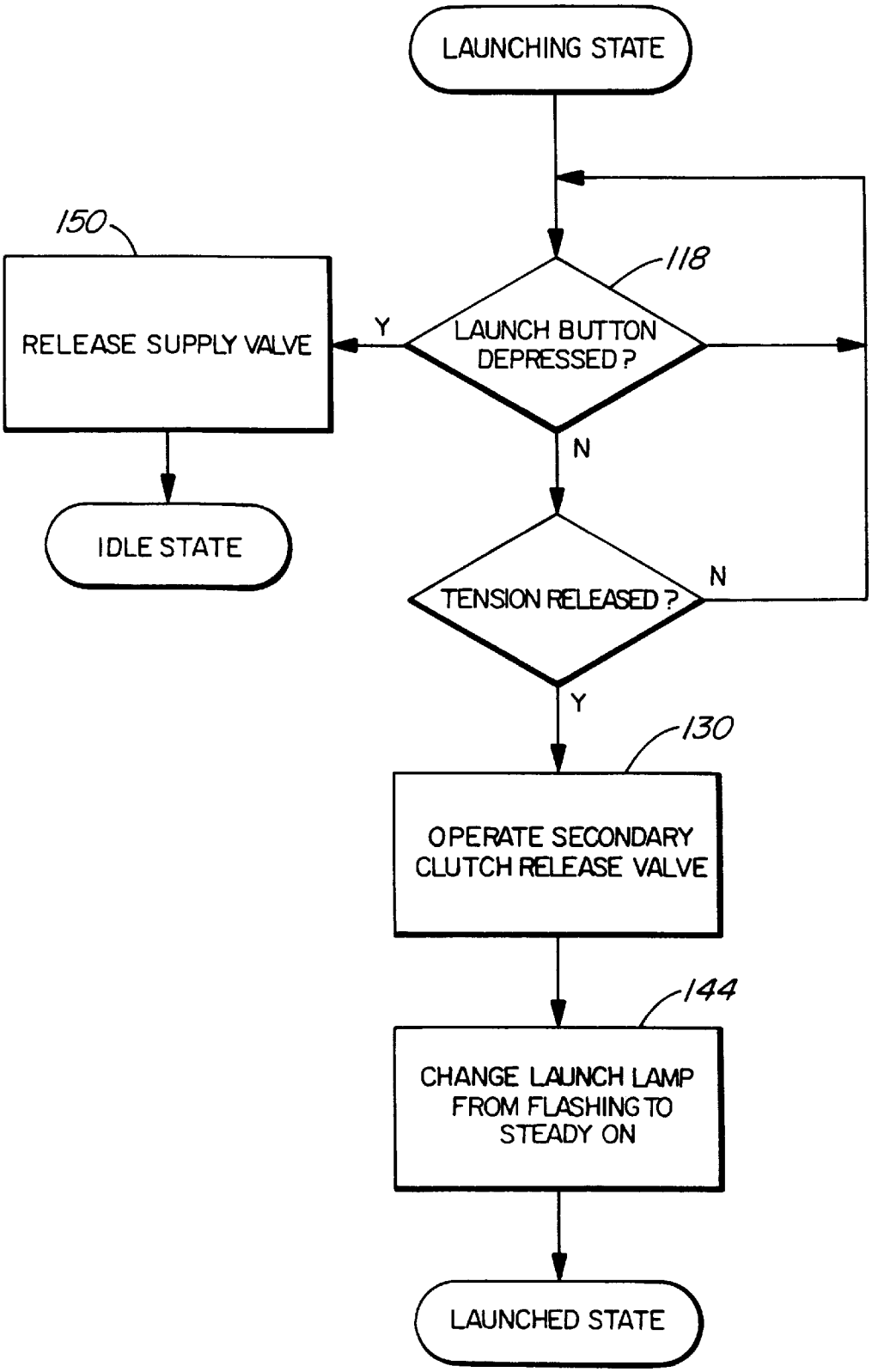
Figure 8:
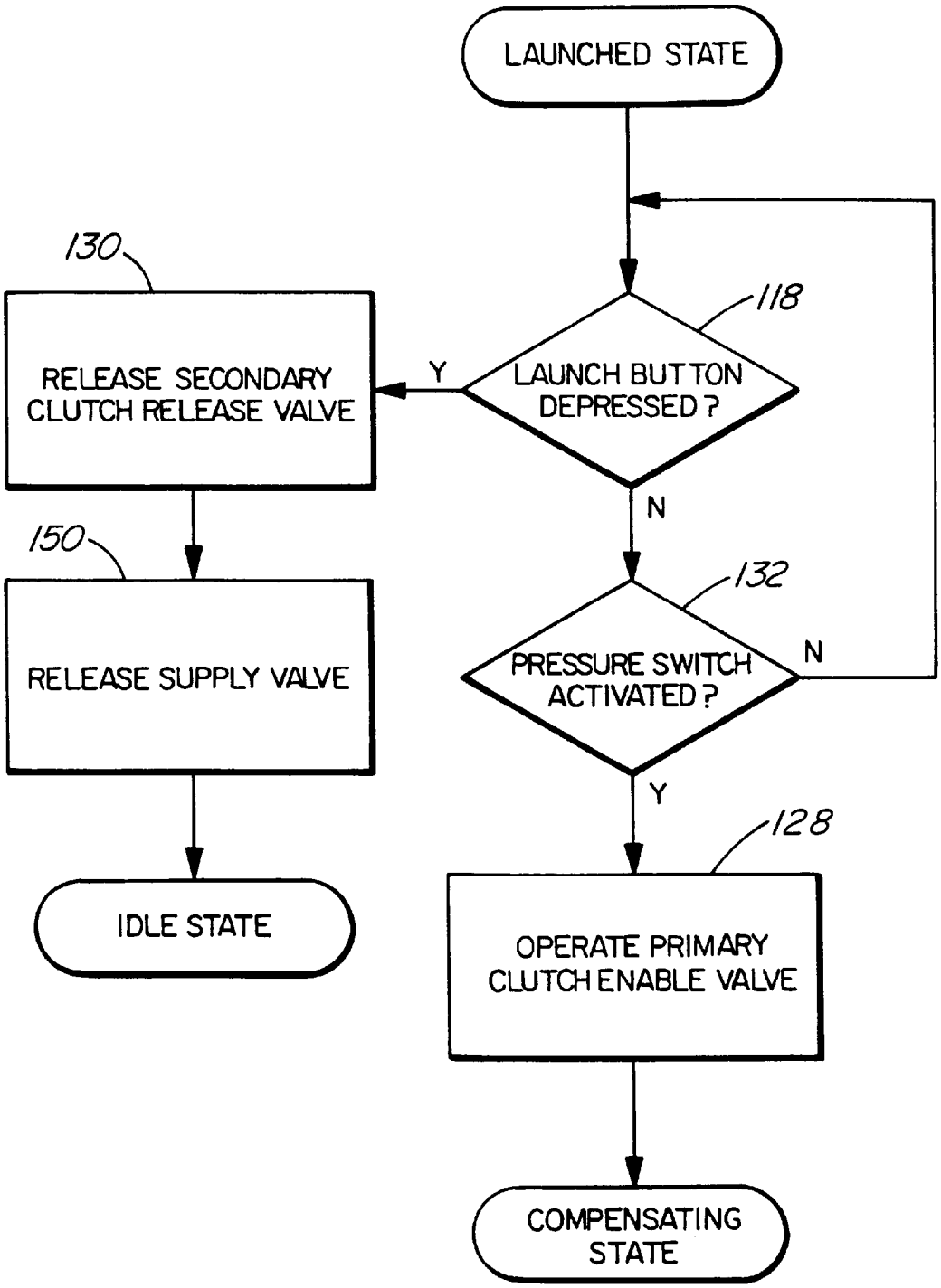
Figure 9:
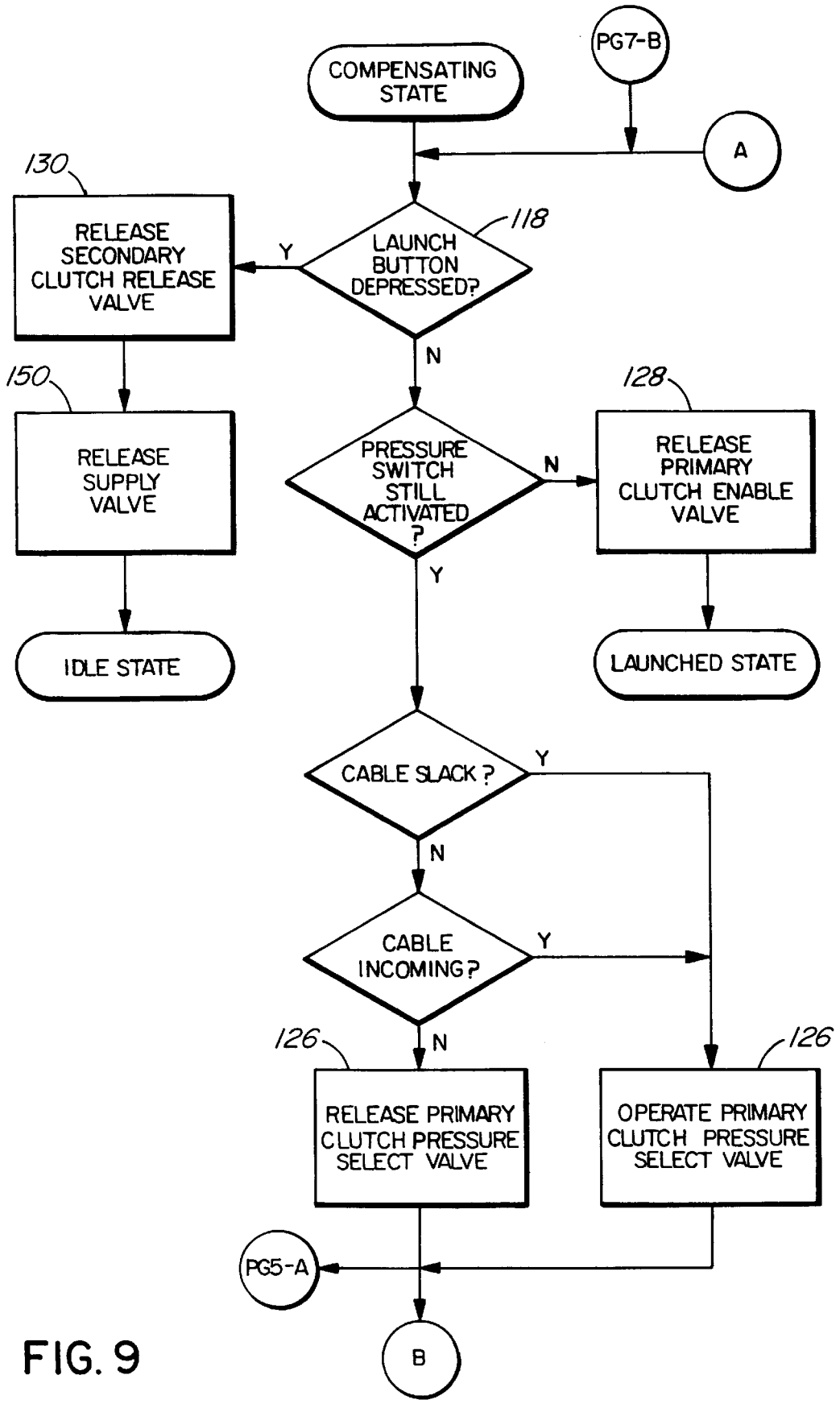
Figure 10:
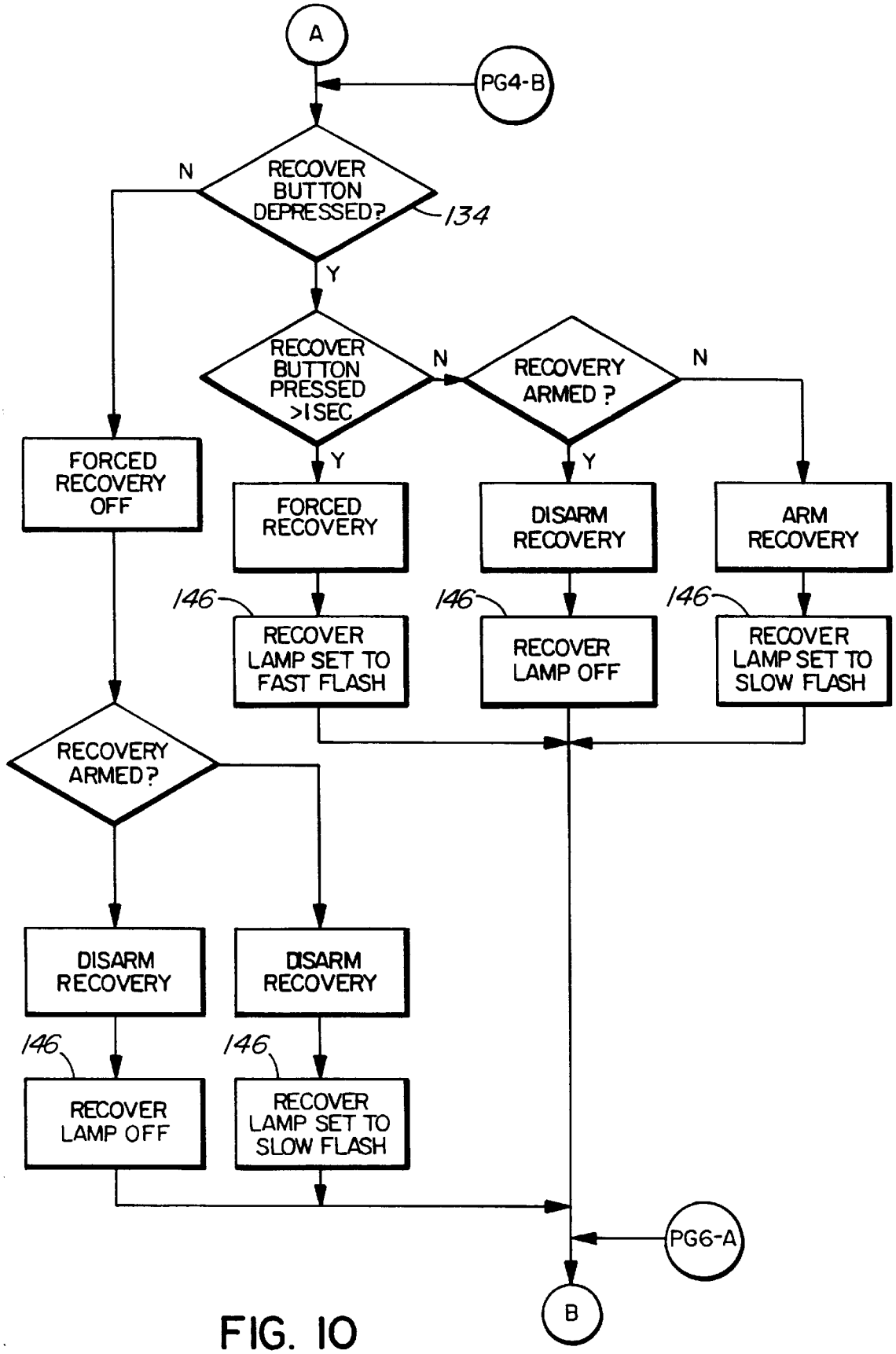
Figure 11:
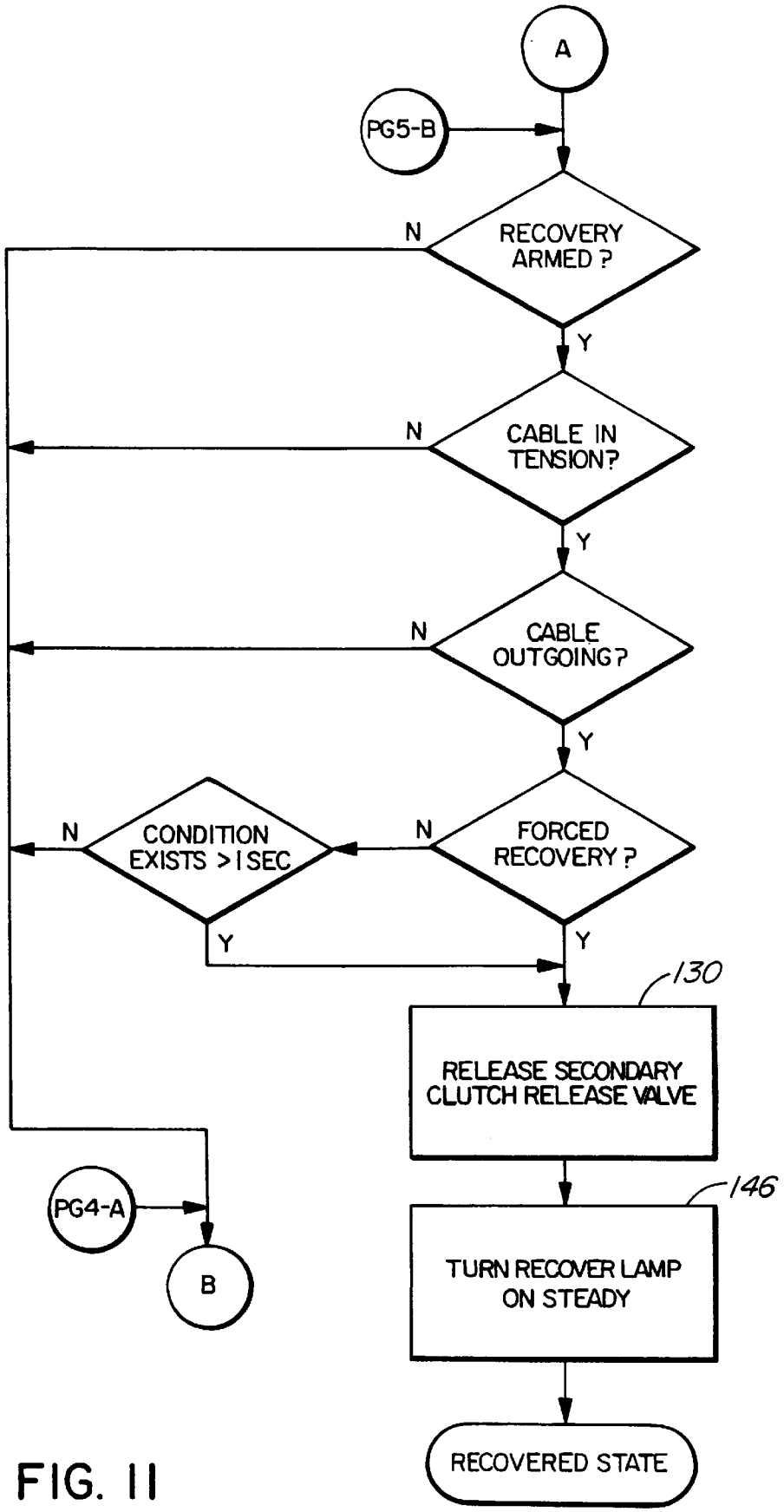
Figure 12:
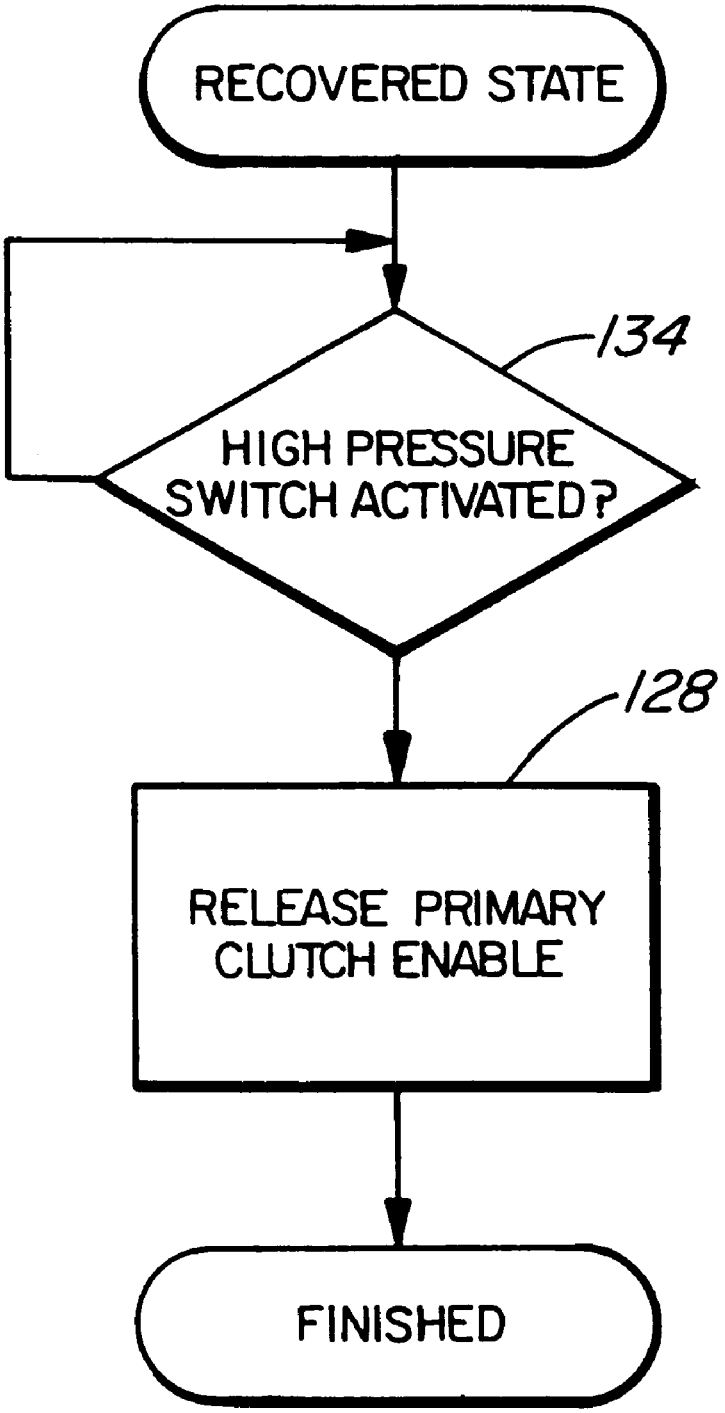

The electronic controls are shown on FIG. 5 and the flow charts for the different operational modes are shown in FIGS. 6 to 12.

Apart from the manual mode, there are four automatic operational modes for the winch. These will be explained in detail. The first mode is the launching mode. Before activating any of the automatic operational modes, the winch operator is able to operate the winch in the manual mode as a standard winch simply by leaving the power off and utilizing the hoist control lever 114 to raise or lower a boat from the platform of a ship or dock and position it over the water.

Figure 4:
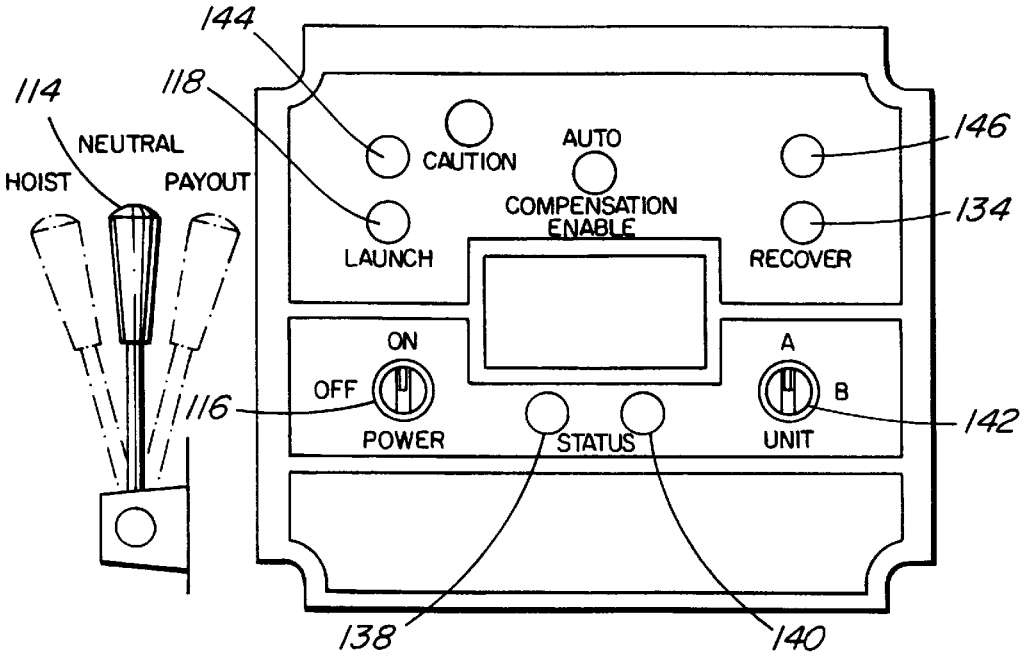
FIG. 4 is a front view showing a control panel for the motion compensation winch of the present invention.

The automatic modes are activated by turning the power switch 116, as shown in FIG. 4, to the ON position. The control console has a red light 138 and a green light 140. The green light 140 initially flashes while the system proceeds through a program of checks, after which the green light 140 stops flashing and stays on. If the red light 138 stays on, then there is a fault in the system. A controller select switch 142 may be turned from A to B or B to A, but if this does not turn off the red light 138, then the problem is not in the control panel itself.

When a boat is lowered almost to water level and is ready to launch, the operator checks that the green light 140 is on and then presses the launch button 118 so the system enters the launch mode. Initially the yellow light 144 on the console flashes, the control lever placed in the pay out position.

In the manual mode, the primary clutch 64 is disengaged and free to rotate, and the secondary clutch 52 is engaged. The control lever 114 provides hydraulic oil to the motor 86 which drives the cable drum 12 through the primary and secondary gear reductions.

As soon as the launch button 118 is pressed, the hydraulic system supply valve 150, as shown in FIG. 3, is turned on supplying hydraulic oil to the system. This provides hydraulic oil to the tension cylinder 106 through pressure reducing valve 120. If the load on the cable is less than the force applied by the tension cylinder 106, which in one embodiment is 300 lbs., then the rocker piston 108 moves the rocker clevis 110 away from the load sensor proximity switch 112. In this situation the launch mode cannot be activated.

When the load on the cable is in excess of 300 lbs., then the gap 100 changes from being on the lefthand side of the end plate teeth 102 to the righthand side of the end plate teeth 102 and the rocker clevis 110 contacts the load sensor proximity switch 112.

Hydraulic oil is applied to the primary clutch 64 through pressure reducing valves 122,124, pressure select valve 126 and primary clutch enable valve 128. Hydraulic oil is also applied through secondary clutch release valve 130, to the secondary clutch 52.

As soon as the boat is launched, the load comes off the cable, and the rocker gear moves so that the gap 100 is on the right of the end plate gear teeth 102. This opens up a space between the rocker clevis 110 and the load sensor proximity switch 112. The load sensor proximity switch 112 sends a signal through the control panel to the secondary clutch release valve 130, releasing the secondary clutch 52 which remains released until the control console is turned off. The released secondary clutch 52 enables the operator to pull the cable off the cable drum or by operating the control lever 114 to activate motion compensation mode. The operator knows when launch has occurred as the flashing light 144 turns from flashing to a solid light.

Motion compensation mode is only activated when the secondary clutch 52 is released. The secondary clutch 52 releases automatically after launching a boat in the water or can be released by activating the free wheel mode on the control console. This is done only when paying out an empty hook when attempting to recover a boat. In order to activate the free wheel mode, both the launch button 118 and the recovery button 134 are depressed for five seconds. The empty hook can now be pulled off the drum 12.

In the motion compensation mode, the winch motor 86 rotates in a hoisting direction continuously. The hoist control lever 114 is placed in the hoist position. The tension on the cable is achieved by the hydraulic motor 86, driving the cable drum 12 in the hoisting direction. The primary reduction is eliminated by application of hydraulic oil on the primary clutch piston 68 so pressure is applied to the primary clutch plates 64 which unifies the motor shaft 44 with the connecting tube 46. The primary internal gear 40 forms part of the primary reduction and increases the drum speed by a ratio of 4.3 to 1 in one embodiment.

The primary clutch 64, while driving in a hoisting direction, compensates for the speed of the wave. If the wave is ascending slower than the speed the hydraulic motor dictates, then the primary clutch 64 allows the friction and divider plates of the primary clutch 64 to slip after the tension in the cable reaches approximately 700 lbs. When the wave is descending with the load, the hydraulic pressure in the primary clutch 64 is reduced allowing the friction and divider plates to slip with less friction providing variable tension on the cable depending on the speed of the descending wave.

A minimum tension on the cable of 300 lbs. is required in the descending direction in order to shift the rocker gear in the pay out direction to activate the load sensor proximity switch 112.

In the motion compensation mode, when the secondary clutch 52 has been released, the winch control lever 114 is moved to the hoisting position and left in that position. A low pressure switch 132, as shown in FIG. 3, is activated as soon as the pressure in the hydraulic motor reaches 300 psi. The low pressure switch 132 activates the primary clutch enable valve 128, which delivers either high or low pressure hydraulic oil to the primary clutch 52 depending on drum rotation. When the drum is paying in, the clutch is charged with high pressure hydraulic oil. When the drum is paying out, the clutch is charged with low pressure hydraulic oil. The cable drum 12 is paying out when the descending load is greater than the counterbalancing friction in the primary clutch 64 caused by the hydraulic motor 86 driving in the hoisting direction. Conversely, the cable drum 12 is paying in when the ascending load is less than the counterbalancing friction in the primary clutch 64.

The friction in the primary clutch 64 is governed by the low and high pressure hydraulic oil in the primary clutch 64. The pressure in the primary clutch 64 is controlled by the load sensor proximity switch 112 and the rotation switch 96. The load sensor proximity switch 112 monitors the load on the hook and the rotation switch 96 monitors drum rotation paying in or paying out.

When activating motion compensation, the hydraulic motor 86 rotates in a direction to drive the cable drum 12 in the paying in direction. If the wave elevates the load the cable drum 12 pays in. In this case the load sensing switch 112 through the control console activates the pressure select valve 126 supplying high pressure hydraulic oil to the primary clutch 64.

The tension switch 112 is deactivated by the tension cylinder 106 for pay in direction and activated by the load on the hook through the rocker gear teeth 98 for pay out direction. The rocker gear teeth 98 rotate in the gap 100 available between the rocker gear teeth 98 on the secondary reduction internal gear 32 and the internal gear teeth 102 on the end plate 104. This gap 100 provides adequate travel for the tension cylinder 106 to deactivate the load sensor proximity switch 112 in pay in direction. This condition happens when the descending load is approaching the turn around of the wave. Because the tension cylinder 106 has a hydraulic pressure equal to approximately 300 lbs., the tension on the cable drum 12 and the gap 100 between the gear teeth 98,102 shifts to the hoisting direction and the tension cylinder 106 deactivates the load sensor proximity switch 112 before the drum starts rotating in the pay in direction. This operates the pressure select solenoid valve 126 which changes the hydraulic oil pressure from low pressure to high pressure at the primary clutch 64 before the wave starts to raise the boat so the cable drum 12 is paying in.

The directional sensor proximity switch 96 monitors the cable drum 12 rotation. While the load sensor proximity switch 112 reacts to the load coming off the hook, the directional sensor proximity switch 96 reacts to the drum turn around after the wave has reached its highest point. When the wave has elevated the load to its highest point and begins descending, the load descends and pulls the cable drum in pay out direction. At that point the directional sensor proximity switch 96 is activated sending a signal to the pressure select solenoid valve 126 shifting the valve to feed low pressure hydraulic oil to the primary clutch 64. This reduces the friction in the primary clutch 64 allowing the load to descend with a minimum tension on the cable of 300 lbs. When the load approaches the bottom of the wave, the tension cylinder 106 shifts the gap 100 between the gear teeth 98,102 in the rocker gear and activates the load sensor proximity switch 112 sending a signal to the pressure select solenoid valve 126 shifting to the high pressure hydraulic oil to the primary clutch 64 driving the drum in the pay in direction, and the cycle continues.

In the recovery mode, the winch is initially in the motion compensation mode. The operator keeps the winch control lever 114 in the pay in direction while the load is being manipulated by the waves. Thus, the cable moves in and out. The operator then elects to recover by pressing the recovery button 134, as shown in FIG. 4, at any time whether the load is ascending or descending. The program logic in the control console scans the following conditions and makes a recovery only if the load sensor proximity switch 112 is energized indicating tension on the cable, therefore the primary clutch enable valve 128 and the pressure select valve 126 are open supplying high pressure hydraulic oil to the primary clutch 64 and the rotation switch 96 is energized indicating that the cable drum 12 is turning in the pay in direction. If these conditions are not in effect, then the logic program ignores the recovery command and waits until these conditions are in effect.

When the required conditions are in compliance with the logic program, secondary clutch release solenoid valve 130 shifts and opens the port to the hydraulic supply tank 136 allowing the secondary clutch 52 to apply while the primary clutch 64 keeps driving freely in hoisting direction through the sprag clutch 48 located between the connecting tube 46 and the secondary clutch hub 50. When the load is elevated by the wave to its maximum height, the secondary clutch 52 and the secondary sprag clutch 48 keeps the connecting tube 46 from rotating in the pay out direction. As a result, this activates the primary gear reduction providing full gear reduction through the secondary gear reduction to the cable drum 12. Not only can the load no longer pay out, but the winch is basically shifted into manual mode capable of lifting full rated load. Once the hydraulic motor pressure reaches 2300 psi the low pressure switch 132 shifts the pressure select valve 126 to low clutch pressure providing minimum friction ready to drive full speed in hoisting direction should a second wave occur. The load is now under the operator's control and it may be stopped any time by moving the winch control lever 114 into the neutral position.

The hydraulic oil or fluid supplied to the primary clutch 64 and the secondary clutch 52 is continually circulating when the clutches are applied and thus cools the clutches when they are slipping.

When the recovery button 134 is pressed a recovery green light 146 starts flashing, the control lever 114 is kept in the hoist position, and when the conditions comply with the logic control the recovery occurs automatically right from the top of the wave crest. The green light turns from flashing to a solid light so the operator is aware recovery has occurred. If a forced recovery is necessary, for example, if the speed of the wave action is higher than can be accommodated by the cable drum 12, the system recognizes this and will not recover. To overcome this situation, the control lever 114 is held in the fully hoist position and the recovery button 134 is pushed down for a half second. Recovery is then immediate and automatic.

The hydraulic supply 148 supplies hydraulic oil through a system supply valve 150. A system pressure relief valve 152 is provided for excessive pressure. There is a low pressure switch 132 and a high pressure switch 154 for monitoring the high and low pressure hydraulic oil to the primary clutch 64.

The control block diagram of FIG. 5 indicates the electronic controls which receive information from the switches 112,96,132,134 and provides signals to the valves 150,130, 126,128. The sequence of operations for the different modes are illustrated in FIGS. 6 to 12.

Various changes may be made to the embodiments shown herein without departing from the scope of the present invention which is limited only by the following claims.

We claim:

1. A motion compensation winch having an automatic launch mode, a motion compensation mode, a free wheel mode and an automatic recovery mode, as well as a manual operating mode, the winch comprising:

a cable drum for winding a cable thereon;

a secondary gear reduction to rotate the drum;

a primary gear reduction between a motor drive shaft and the secondary gear reduction;

a hydraulic motor on the motor drive shaft;

a primary clutch to engage and disengage the primary gear reduction and drive the cable drum through the secondary gear reduction eliminating the primary gear reduction, thus increasing rotational speed of the cable drum;

a rotational sensor to sense direction of cable drum rotation;

a load sensor to determine when a tension on the cable is above or below a predetermined value;

a secondary clutch to disengage the cable drum and permit the cable drum to rotate freely, and a control system to provide:

the automatic launch mode wherein the load sensor senses when the tension on the cable is below the predetermined value and disengages the secondary clutch to place the winch in the free wheel mode;

the motion compensation mode wherein the rotational sensor senses when the cable drum is paying in, selects a preset high pressure oil supply for the primary clutch to increase friction and still permit some clutch slippage to retain tension in the cable, and senses when the cable drum is paying out, selects a preset low pressure hydraulic oil supply for the primary clutch to permit clutch slippage to retain tension in the cable, and the automatic recovery mode wherein the directional sensor senses the cable drum is paying in, and when the load sensor determines the cable is taut and the tension on the cable has increased over the predetermined value, the secondary clutch engages so full torque is applied to the cable drum through the primary gear reduction and the secondary gear reduction to raise the load.

2. The motion compensation winch according to claim 1 wherein the rotational direction sensor is a rocker arm movable by a clutch to activate a directional sensor proximity switch.

3. The motion compensation winch according to claim 1 wherein the load sensor is a load tension cylinder with a load tension piston therein together with rocker gear movement sensing force direction and a load sensor proximity switch.

4. The motion compensation winch according to claim 1 wherein a cable is attached to the cable drum.

5. The motion compensation winch according to claim 1 wherein the control system has a control panel with a launch button to initiate the launch mode and a recovery button to initiate the recovery mode.

6. The motion compensation winch according to claim 5 wherein lights are provided to indicate when the winch is in the launch mode and the recovery mode.

7. The motion compensation winch according to claim 1 including a control switch for the control system which when in the OFF position permits the winch to be used manually by a manual control lever.

8. The motion compensation winch according to claim 1 wherein the hydraulic motor is a fixed displacement hydraulic motor and has a dynamic brake included therein, the brake being connected with an hydraulic oil supply from the hydraulic motor so that the load on the cable and pressure of the hydraulic oil supply permits the dynamic brake to slip under full control.

9. The motion compensation winch according to claim 8 including a sprag clutch between the brake and the drive shaft to prevent the cable drum from paying out when the brake is engaged.

10. The motion compensation winch according to claim 1 including a pressure reducing valve in the high pressure oil supply to provide the low pressure oil supply.

11. The motion compensation winch according to claim 1 including a sprag clutch with the secondary clutch to prevent the cable drum from paying out when the secondary clutch is engaged.

12. The motion compensation winch according to claim 1 including a control lever with a pay in, neutral and pay out position.

13. The motion compensation winch according to claim 1 including oil circulation for the primary clutch and the secondary clutch for cooling.

14. The motion compensation winch according to claim 1 wherein the load sensor determines when the load on the cable is above or below about 300 lbs.

15. The motion compensation winch according to claim 1 wherein the high pressure hydraulic oil supply to the primary clutch allows limited slipping when the cable drum is paying in and the low pressure hydraulic oil supply to the primary clutch reduces friction in the primary clutch as a wave drops to ensure the load on the cable drops with the wave, the low pressure hydraulic oil supply to the primary clutch acts as a counterbalance against inertia generated by the cable drum paying out as the load descends.

16. A method of controlling a motion compensation winch having a cable drum for winding a cable with a load thereon, and a variable speed hydraulic motor to drive the cable drum from a motor drive shaft, the method comprising the steps of:

selecting an operational mode for the winch from an automatic launch mode, a motion compensation mode, a free wheel mode and an automatic recovery mode;

sensing a load on the cable above or below a predetermined value;

sensing whether the cable drum is paying in or paying out, and manually operating a winch control to provide hydraulic oil to the hydraulic motor to rotate the cable drum for raising or lowering the load.

17. The method of controlling a motion compensation winch according to claim 16 including the step of controlling slippage of a primary clutch in the motion compensation mode so the cable remains taut as a wave rises.

18. The method of controlling a motion compensation winch according to claim 16 including the steps of reducing pressure in a primary clutch to allow the primary clutch to slip and the cable drum to pay out thus keeping the cable taut in the motion compensation mode when the load is dropping as a wave falls away.

19. The method of controlling a motion compensation winch according to claim 16 including the steps of releasing a brake at the same time as oil is supplied to the variable speed hydraulic motor to lower the load so that the brake and the motor operate in equilibrium.

20. The method of controlling a motion compensation winch according to claim 16 wherein the automatic launch mode is selected, comprising the steps of:

manually operating the winch control to lower the load;

sensing when the load on the cable changes to below the predetermined value, and disengaging a secondary clutch so the cable drum is in the free wheel mode and free to rotate.

21. The method of controlling a motion compensation winch according to claim 16 wherein the motion compensation mode is selected, comprising the steps of:

manually operating the winch control to rotate the motor drive shaft in a direction to raise the load;

sensing when the cable drum is paying in, and applying a high pressure hydraulic oil supply to a primary clutch between the motor drive shaft and the cable drum, permitting some clutch slippage and ensuring the cable remains taut, and sensing when the cable drum is paying out and applying a low pressure hydraulic oil supply to the primary clutch, permitting clutch slippage and ensuring the cable remains taut.

22. The method of controlling a motion compensation winch according to claim 16 wherein the free wheel mode is selected, comprising the steps of:

disengaging the motor drive shaft from the cable drum with a secondary clutch.

23. The method of controlling a motion compensation winch according to claim 16 wherein the automatic recovery mode is selected, comprising the steps of:

manually operating the winch control to rotate the motor drive shaft in a direction to raise the load;

sensing when the cable drum is paying in;

sensing when the cable is taut and the load on the cable changes to above the predetermined value, and activating a primary gear reduction to act with a secondary gear reduction to provide full gear reduction and raise the load on the cable drum.

* * * * *